US008162433B2

(12) United States Patent
Ramakrishnan et al.

(10) Patent No.: US 8,162,433 B2
(45) Date of Patent: Apr. 24, 2012

(54) SYSTEM AND METHOD FOR SCHEDULING INK JET RECOVERY IN AN INK JET PRINTER

(75) Inventors: Bhaskar T. Ramakrishnan, Wilsonville, OR (US); Mary Lynne Morrow, Mulalla, OR (US)

(73) Assignee: Xerox Corporation, Norwalk, CT (US)

( * ) Notice: Subject to any disclaimer, the term of this patent is extended or adjusted under 35 U.S.C. 154(b) by 447 days.

(21) Appl. No.: 12/413,785

(22) Filed: Mar. 30, 2009

(65) Prior Publication Data

US 2010/0245454 A1 Sep. 30, 2010

(51) Int. Cl.
*B41J 2/165* (2006.01)

(52) U.S. Cl. ..... 347/23; 347/19; 347/5

(58) Field of Classification Search ..... 347/5, 9, 347/19, 23, 12
See application file for complete search history.

(56) References Cited

U.S. PATENT DOCUMENTS

| | | | | |
|---|---|---|---|---|
| 5,675,365 | A | 10/1997 | Becerra et al. | |
| 5,798,773 | A * | 8/1998 | Hiramatsu et al. | 347/19 |
| 6,130,684 | A | 10/2000 | Premnath et al. | |
| 6,293,645 | B1 * | 9/2001 | Kim | 347/23 |
| 6,520,618 | B2 | 2/2003 | Yoshida et al. | |
| 6,669,326 | B2 | 12/2003 | Yazawa et al. | |
| 6,964,530 | B2 | 11/2005 | Gobbak et al. | |
| 7,152,942 | B2 | 12/2006 | Walmsley et al. | |
| 7,165,824 | B2 | 1/2007 | Walmsley et al. | |
| 7,168,783 | B2 | 1/2007 | Naito | |
| 7,891,754 | B2 * | 2/2011 | Nagamura et al. | 347/19 |
| 2001/0015818 | A1 | 8/2001 | Kawanabe et al. | |
| 2004/0260803 | A1 | 12/2004 | Nakamura | |

* cited by examiner

*Primary Examiner* — Lam S Nguyen
(74) *Attorney, Agent, or Firm* — Maginot, Moore & Beck, LLP

(57) ABSTRACT

A method enables an ink jet image generating system to select an operational mode in response to detection of a missing ink jet. The method includes generating a digital image of an ink image on an image receiving member of an ink jet image generating system, detecting missing inkjets in a printhead of an ink jet image generating system from the digital image of the ink image on the image receiving member, and selecting an operational mode for the ink jet image generating system in response to the detection of at least one missing ink jet.

16 Claims, 4 Drawing Sheets

SYSTEM AND METHOD FOR SCHEDULING INK JET RECOVERY IN AN INK JET PRINTER

TECHNICAL FIELD

This disclosure relates generally to devices that generate images, and more particularly, for imaging devices that eject ink from ink jets to form an image.

BACKGROUND

Devices that eject ink to generate images are well known. Throughout the life cycle of these devices, the image generating ability of the device requires evaluation and, if the images contain detectable errors, correction. Before such an imaging device leaves a manufacturing facility, the device should be calibrated to ensure that images are generated by the device without perceptible faults. As the device is used, the device and its environment may experience temperature instabilities and other conditions that may cause components of the device to expand and shift in relation to one another. As the device is used, the intrinsic performance of the device may change reversibly or irreversibly. Consequently, the image generating ability of such a device requires evaluation and adjustment to compensate for the changes experienced by the device during its life cycle. Sometimes these evaluations and adjustments are made at time or usage intervals, while at other times the adjustments are made during service calls made by trained technicians.

In ink jet imaging devices, ink jets expel ink through the response of piezoelectric actuators to firing signals generated by a printhead controller in the device. During the life cycle of the imaging device and from time to time during operation of the device, an ink jet may fail to expel one or more ink drops. In some instances, these missing ink jets may return to operational status without intervention. In other instances, one or more purge cycles may be required to return an ink jet to operational status. A purge cycle may be performed by introducing pressurized air to a printhead to expel ink from ink jet openings. In other purge cycles, the ink in a printhead is allowed to cool so it solidifies and then heat is reapplied to the printhead to melt the solidified ink before pressurized air is applied to expel ink from the ink jets. Purge cycles interfere with printer operations as images cannot be generated with a printhead when ink is being purged from the printhead. Consequently, scheduling purge cycles for the purpose of restoring ink jets to operational status is an important consideration for keeping an ink jet imaging system available for printing.

SUMMARY

A system identifies missing jets and schedules ink jet maintenance events in a manner that better preserves the operational capability of an ink jet imaging system. The system includes an image capture device configured to generate a digital image of an ink image on an image receiving member of an ink jet image generating system, an image evaluator configured to detect missing inkjets in a printhead of an ink jet image generating system from the digital image of the ink image on the image receiving member, and a controller configured to select an operational mode for the ink jet image generating system in response to the image evaluator detecting at least one missing ink jet.

A method of operating an ink jet imaging system identifies missing jets and schedules ink jet maintenance events in a manner that better preserves the operational capability of the ink jet imaging system. The method includes generating a digital image of an ink image on an image receiving member of an ink jet image generating system, detecting missing inkjets in a printhead of an ink jet image generating system from the digital image of the ink image on the image receiving member, and selecting an operational mode for the ink jet image generating system in response to the detection of at least one missing ink jet.

BRIEF DESCRIPTION OF THE DRAWINGS

The foregoing aspects and other features of a system that identifies missing jets and schedules ink jet recovery actions during non-usage periods are explained in the following description, taken in connection with the accompanying drawings.

DETAILED DESCRIPTION

Figure 1:
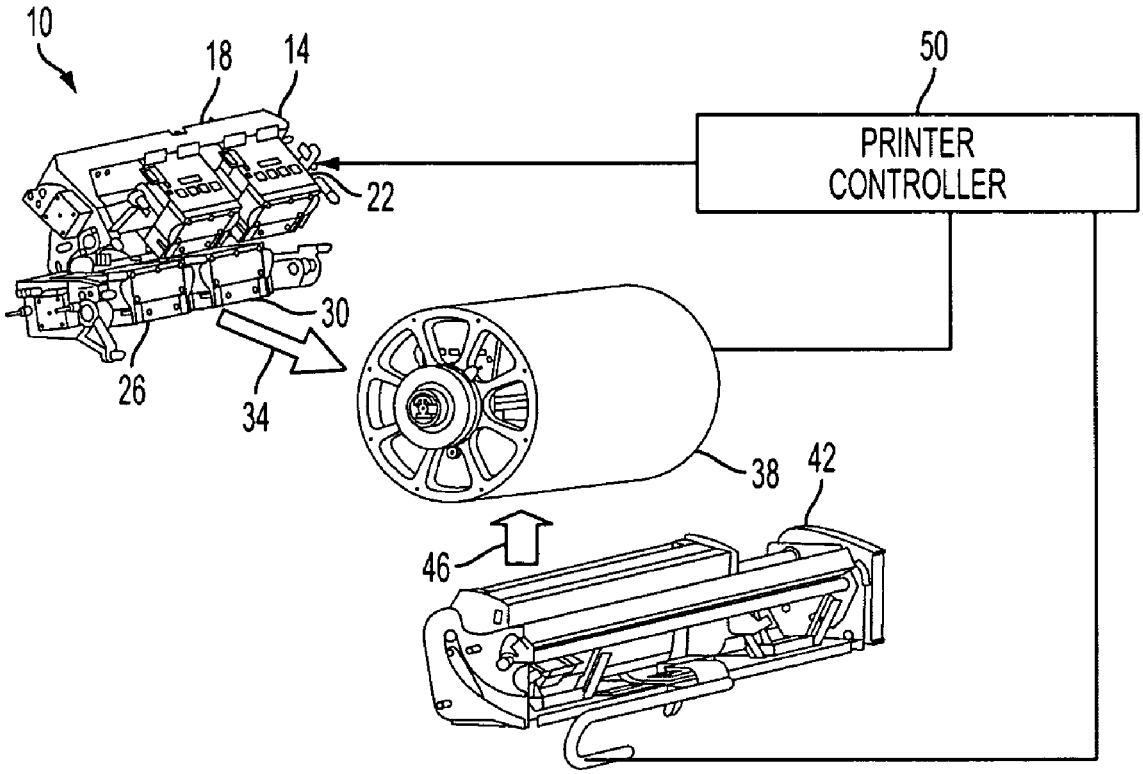
FIG. 1 is a block diagram of a printer depicting the components operated by a controller that schedules ink jet maintenance and adjusts the operation of the printer in response to the detection of missing jets.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multifunction machine, or the like. Also, the description presented below is directed to a system that schedules ink jet recovery actions based on ink jet usage and for operating an ink jet printer to compensate for missing ink jets. Although the system and method are described with reference to an ink jet imaging device that uses solid ink, the reader should also appreciate that the principles set forth in this description are applicable to ink jet imaging systems that use aqueous inks, gel inks, emulsified inks, or the like.

As shown in FIG. 1, a particular image generating system may be a printer. The printer 10 includes a printhead assembly 14, a rotating intermediate imaging member 38, an image capture device 42, such as a scanner, and a printer controller 50. The printhead assembly 14 includes four printheads 18, 22, 26, and 30. Typically, each of these printheads ejects ink, indicated by arrow 34, to form an image on the imaging member 38. The four printheads are arranged in a two by two matrix with the printheads in one row being staggered with reference to the printheads in the other row. Controlled firing of the inkjets in the printheads in synchronization with the rotation of the imaging member 38 enables the formation of single continuous horizontal bar across the length of the imaging member. The intermediate imaging member 38 may be a rotating drum, as shown in the figure, belt, or other substrate for receiving ink ejected from the printheads. Alternatively, the printheads may eject ink onto a substrate of media moving along a path adjacent to the printheads. The image capture device 42 includes a light source for illuminating the imaging member 38 and a set of light sensors, each of which generates an electrical signal having an amplitude corresponding to the intensity of the reflected light received by a sensor.

The printer controller 50 includes memory storage for data and programmed instructions. The controller may be implemented with general or specialized programmable processors that execute programmed instructions. The instructions and data required to perform the programmed functions may be stored in memory associated with the processors or controllers. The processors, their memories, and interface circuitry configure the controllers to perform the functions, such as the calibration tools and the scheduling of the selection of the tools, as described more fully below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

The controller 50 in FIG. 1 is coupled to the printhead assembly 14, the imaging member 38, and the image capture device 42 to synchronize the operation of these subsystems. To generate an image, the controller renders a digital image in a memory and generates inkjet firing signals from the digital image. The firing signals are delivered to the printheads in the assembly 14 to cause the inkjets to eject ink selectively. The controller is also coupled to the imaging member 38 to control the rate and direction of rotation of the imaging member 38. Controller 50 also generates signals to activate the image capture device for illumination of the imaging member 38 and generation of a digital signal that corresponds to the image on the member 38. Sometimes this digital signal is referred to as an image on the drum or IOD. This digital signal is received by the controller 50 for storage and processing as a digital image. The portion of the controller that is configured by programmed instructions and associated circuitry for analysis of the digital image and detection of features within the image is sometimes called an image evaluator.

Ink jet recovery action, as used in this document, refers to any type of operation that may be used to enable a missing or weak ink jet to recover the ability to respond to firing signals as expected for proper printing from the ink jet. These recovery actions may include cessation of use of a missing or weak ink jet for a predetermined period of time, applying a voltage to the ink jet that is less a firing signal threshold, applying a voltage to the ink jet that is significantly higher than a firing signal threshold, pulsing a voltage applied to the ink jet to attempt to eject ink rapidly over a predetermined period of time, or any other recovery action suitable for a given printing technology. Additionally, the terms "missing ink jet" and "weak ink jet" refer to defectively operating ink jets and may be used interchangeably. Thus, a missing ink jet also refers to a weak ink jet or vice versa.

Figure 2:
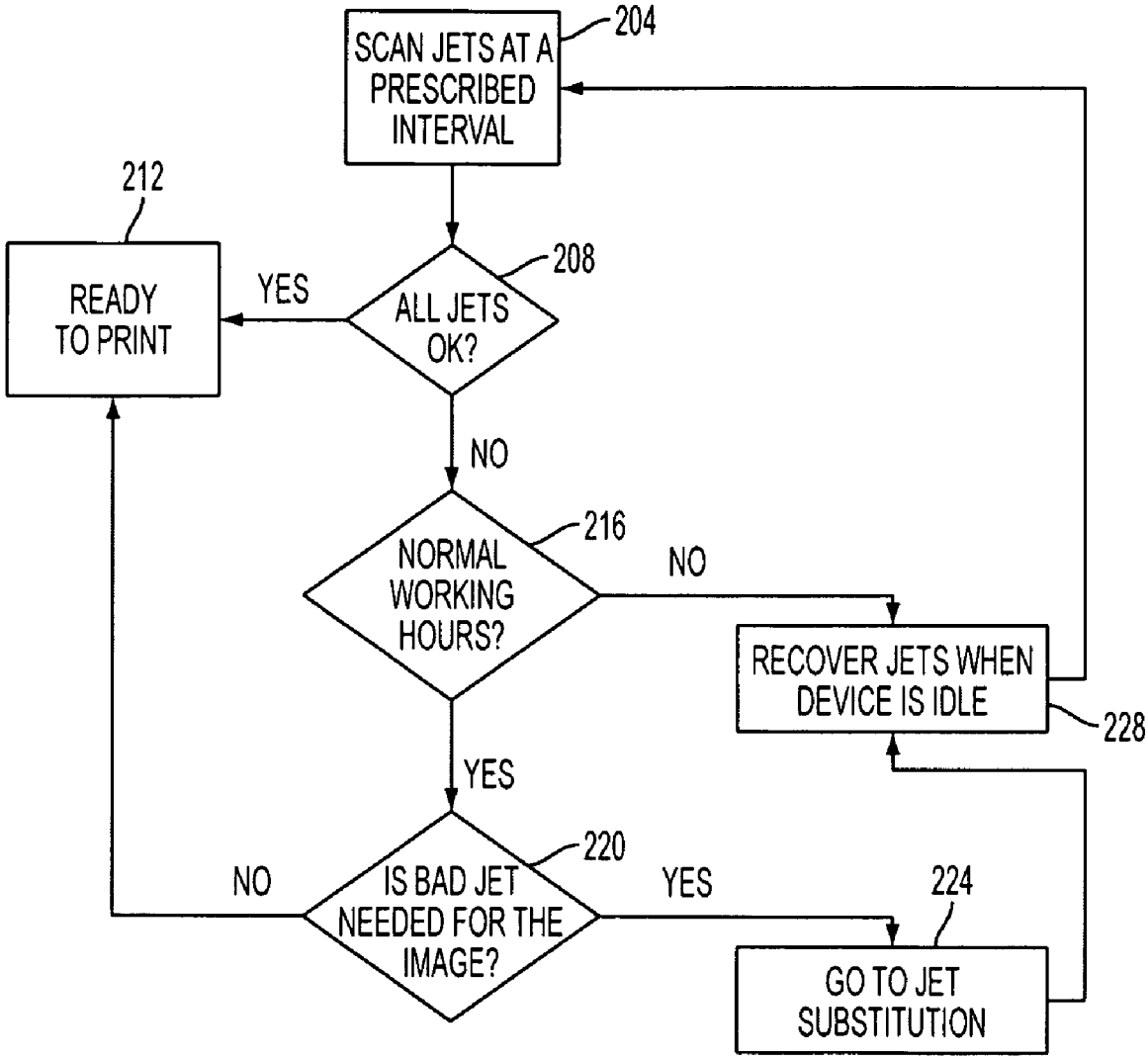
FIG. 2 is a flow diagram for a process of scheduling ink jet recovery actions.

To evaluate the need for scheduling ink jet recovery actions, the controller 50 may perform the process shown in FIG. 2. At a predetermined interval, the controller initiates a process that generates a test pattern on the image receiving member, generates a digital image of the test pattern on the imaging member, and analyzes the digital image to identify missing jets (block 204). The image receiving member may be an intermediate image receiving member, such as a rotating image drum or an endless rotating belt, or media that receives an ink image directly from a printhead. The media may be in the form of sheets or a moving web and the generation of the image may occur within the printing system or externally with a subsequent transmission of the image to the controller of the ink jet recovery system. If all of the ink jets are operational (block 208), the printer is returned to its operational printing mode (block 212). If one or more ink jets are detected as being missing or weak, the process determines whether the current time is within normal operational hours for the printer (block 216). If the current time during the period of time for normal usage of the printer, the process determines whether the ink jet(s) are needed frequently for printing images (block 220). If the missing or weak ink jets are not needed frequently for printing, then the printer is returned to its operational mode (block 212). Otherwise, a jet substitution mode is selected for firing the ink jets of the printhead having the missing or weak ink jets (block 224). In implementing the jet substitution mode, the controller operates an ink jet that neighbors the missing or weak ink jet to eject ink that would have been ejected by the missing or weak ink jet. This mode of operating the printer continues until the current time is outside the normal working hours for the printer. At that time, ink jet recovery actions are instituted in an effort to restore the ink jets to an operational status (block 228).

In one embodiment, one ink jet recovery action is performed with the controller operating each printhead in which a missing or weak ink jet is located in a warm purge mode. The controller then generates signals for the operation of the printer to print a test pattern on the image receiving member, generate a digital image of the test pattern on the image receiving member, and processes the digital image to determine whether the missing or weak ink jet has returned to operational status. If the missing or weak ink jet does not return to operational status, the controller may operate the printhead in a warm purge mode, generate the test pattern, image the test pattern, and process the test pattern to determine whether the ink jet has returned to operational status. The controller may repeat this cycle up to some predetermined number of times in an effort to return the missing or weak ink jet to operational status. If the ink jet does not return to operational status, the controller may allow the ink in the printhead to solidify before operating the printhead in a warm purge. The solidify/warm purge cycle may be performed multiple times in an effort to return the missing or weak ink jet to operational status. If the missing or weak ink jet fails to return to operational status, the controller identifies the ink jet as a chronic ink jet, generates a chronic ink jet failure code, and displays the code on the display of the printer. The code may be intelligible to a printer user or the code may be encrypted to enable service personnel to identify the failure without indiscriminately identifying the fault to others who may attempt improper service procedures.

As noted above, a jet substitution mode may be used to operate the imaging system while waiting for the ink jet recovery action to be implemented. In the jet substitution mode, the controller alters the printing speed of the imaging system. In one embodiment, the imaging system has a default printing speed that is less than the maximum printing speed possible for the system. In this embodiment, the controller increases the operating speed of the imaging system to implement the jet substitution mode. As noted previously, the jet substitution mode includes the controller operating a neighboring ink jet to supply the ink that would have been ejected by the missing or weak ink jet. The overhead for this substitution control may reduce the throughput of the imaging system. In an effort to compensate for this overhead, the controller may operate the image generating system at a higher printing speed. In one embodiment, the printing speed is adjusted only in response to a missing or weak ink jet being in the printhead used to eject black ink as this printhead is used most frequently for text in images. In another embodiment, the increase in the printing speed may be implemented in response to any ink jet in any printhead being a missing or a weak ink jet.

In another embodiment, the adjustment in printing speed and/or the scheduling of an ink jet recovery action for a later time may be performed in response to an ink jet usage history and location. In one embodiment, a usage history is kept for each ink jet in each printhead. A usage history may be implemented by storing a count for each time that an image has a pixel that would result in the controller generating a firing signal for the ink jet. Thus, the counter would indicate how frequently the ink jet is used for ink image generation. This counter may be compared to a predetermined threshold to determine whether the rate of usage for the corresponding ink jet warrants an immediate ink jet recovery action or printing speed adjustment. In one embodiment, the predetermined threshold is fifty percent of the ink images generated. Thus, if the ink jet detected to be a missing or weak ink jet is used to generate fifty percent or more of the ink images generated by the image generating device since the last initialization of the counters, then an ink jet recovery action is performed immediately or the printing speed is increased to compensate for the increased overhead that occurs in the jet substitution mode.

Figure 3:
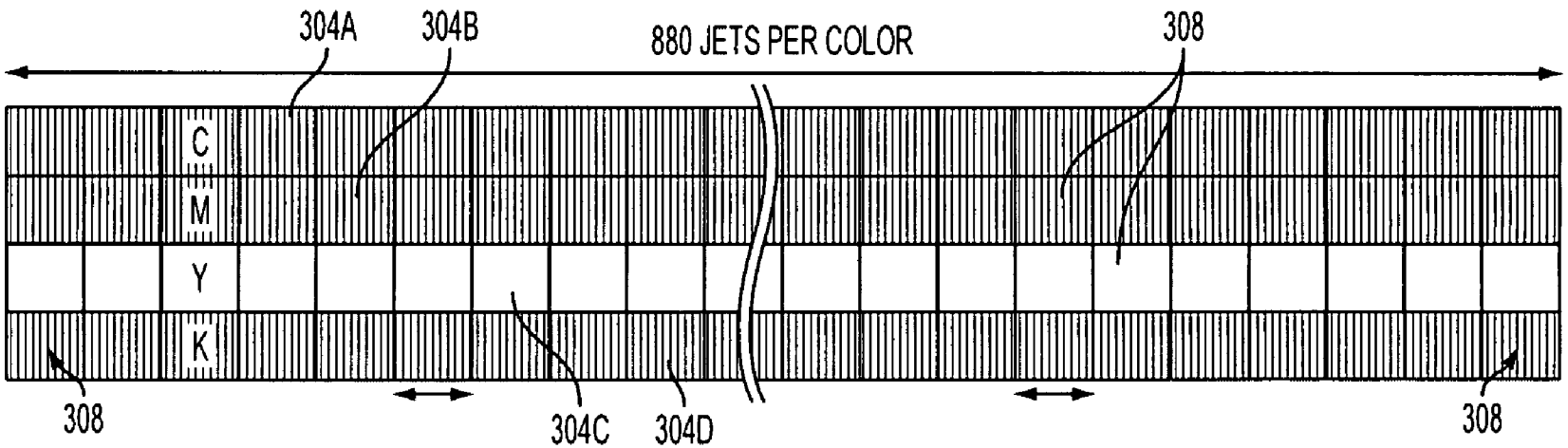
FIG. 3 is a diagram of a scheme for organizing ink jets in four printheads to maintain a history of ink jet usage.

In the embodiment that stores a counter for each ink jet in each printhead, the amount of memory may be substantial. In an effort to reduce the number of counters maintained in memory, one embodiment uses a mapping scheme that is represented by the illustration shown in FIG. 3. As shown in that figure, each printhead for the different colors may be represented as a rectangular array of ink jets 304A, 304B, 304C, and 304D. Each array may be divided into a plurality of sectors 308. In one embodiment, a printhead having 880 ink jets is divided into 80 sectors with each sector having eleven ink jets per sector. In this embodiment, the double headed arrows in FIG. 3 represent a width of approximately 5 mm. Each time a digital image has a pixel that would result in a firing signal being generated for any ink jet in a sector, the counter for that sector is incremented. These sector counters are compared to a predetermined threshold as discussed above to determine whether an immediate ink jet recovery action or increase in printing speed occurs in response to the detection of a missing or weak ink jet in a sector. The sector counter may be maintained in a sliding window manner to enable the counters to reflect more recent ink image generation rather than older ink image generation. In one embodiment, if the counter of a sector indicates the sector is used for at least twenty percent of the ink images generated by the system, then an immediate ink jet recovery action or an increase in printing speed occurs in response to the detection of a missing or weak ink jet in the sector.

The adjustment of the printing speed or the performance of an immediate ink jet recovery action may alternatively or additionally be made with reference to the location of the printhead. Most ink images are formed on an ink receiving substrate with the length of the image being in the cross-process direction and the width of the image being in the process direction. Thus, ink images for paper sizes of longer paper lengths, such as legal size (fourteen inches) and the like are typically generated less frequently. Consequently, ink jets used to generate ink drops corresponding to pixels at the top and bottom of these images are used less frequently and, therefore, may not warrant immediate ink jet recovery action or an increase in printing speed. In one embodiment, ink jets used to eject ink drops for pixels in images to be produced for A4 or smaller sizes may result in immediate ink jet recovery action or selection of the jet substitution mode with an increase in printing speed.

Figure 4:
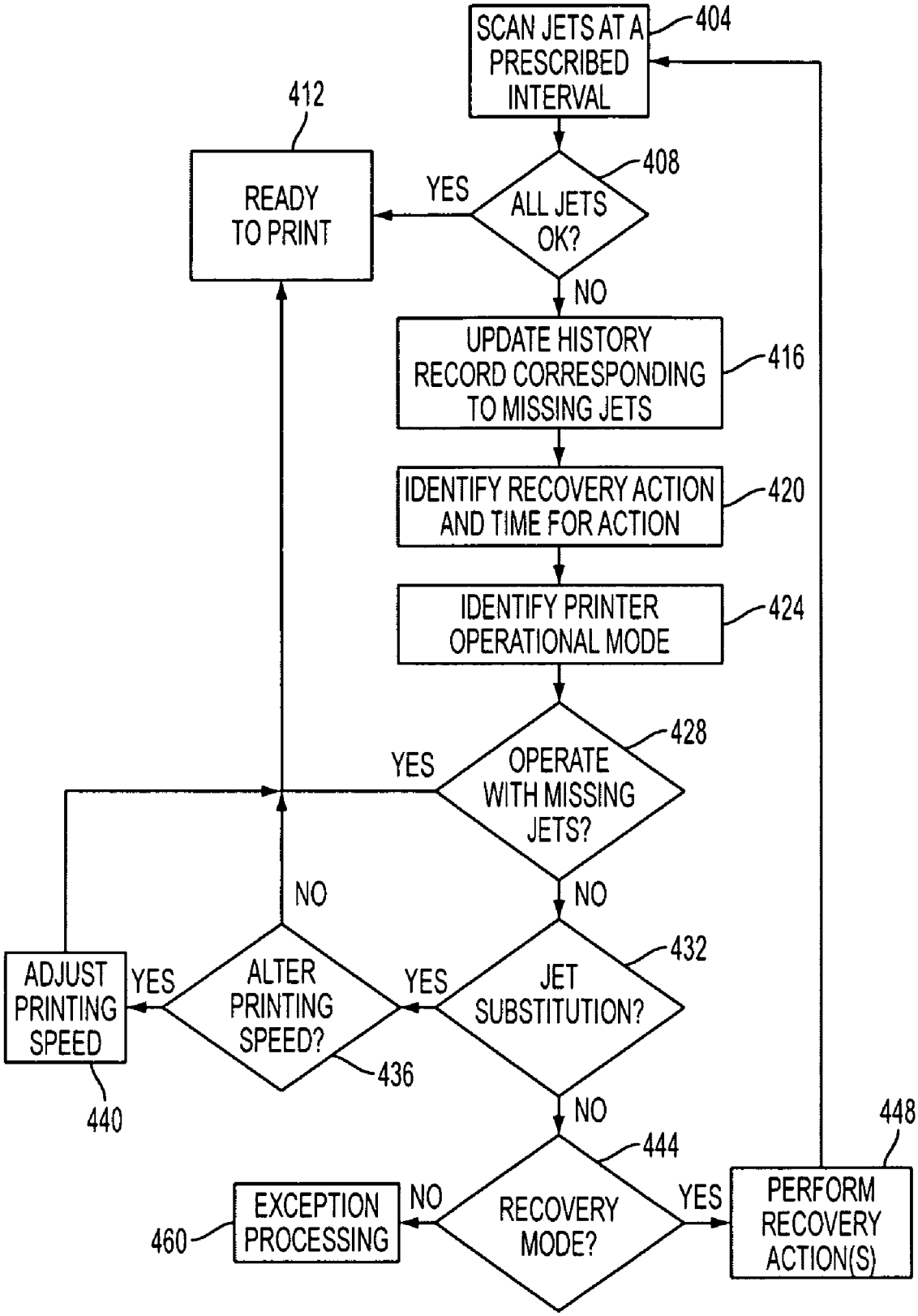
FIG. 4 is a flow diagram of another process that may be used to operate an ink image generating system in response to the detection of missing ink jets.

Another process that may be used to operate an ink image generating system is shown in FIG. 4. At a predetermined interval, the controller initiates a process that generates an ink image on the image receiving member, generates a digital image of the ink image on the image receiving member, and analyzes the digital image to identify missing jets (block 404). If all of the ink jets are operational (block 408), the printer is returned to its operational printing mode (block 412). If one or more ink jets are detected as being missing or weak, the process updates a history record for each ink jet detected as being missing (block 416). History records may be kept for each ink jet, each printhead sector, or a combination of the two. An example of a history record for an ink jet may include an ink jet usage parameter, a count of the number of times the ink jet has been detected as being missing, a count of the number of times that the ink jet has been recovered, and a position for ink drops ejected by the ink jet onto the image receiving member. The use of these parameters stored in the history record is discussed in more detail below.

The process also identifies a recovery action and a time for the identified recovery action (block 420). The identification of the recovery action and a time for performing the recovery action may be made with reference to the history record. For example, a recovery action and a time for performing the recovery action may be identified in response to the ink jet usage parameter of the history record indicating the ink jet detected as being missing has been used in at least a predetermined number of ink images generated by the ink image generating system. In another example, a recovery action and a time for performing the recovery action may be identified in response to the position of the ink drops ejected by the ink jet being detected as being missing as being within a predetermined print zone, such as the A4 print zone discussed above. Other historical data may be used to identify a recovery action. For example, a recovery action and a time for performing the recovery action may be identified in response to the number of ink jets detected as being missing being greater than a predetermined number of ink jets. Historical data regarding the ink image generating system may also be used to identify a recovery action. For example, a recovery action and a time for performing the recovery action may be identified in response to the ink image generating system being configured to generate color images. Color images require more ink jets to be operational so missing jets that may present issues with color images may not appreciably affect mono-color printing. The time for a recovery action may be scheduled for non-operational hours or immediately, if the ink jet(s) have been determined to be important for current operation of the ink image generating system.

The process also identifies an operational mode for the ink image generating system (block 424). The operational mode may be selected with reference to a number of parameters. For example, even though a recovery action and time may have been identified for an ink jet, the ink jet may be determined to be bad and no recovery action taken. In one embodiment, the number of times the ink jet has been detected as being missing is compared to a predetermined threshold and if the count equals or exceeds the threshold, the ink jet status is set to a bad jet status and the recovery action is rescinded. A similar response may occur if the count for the number of times that the ink jet has responded to a recovery action equals or exceeds a predetermined threshold. That is, the process may determine that the ink jet responds to a recovery action, but the operational status of the ink jet is short-lived. Consequently, the process may rescind the recovery action. In another embodiment, the process may determine that the number of missing ink jets is small enough or scattered enough that no recovery action need by taken. Thus, any identified recovery action may be rescinded. To set the operational mode, the process evaluates such parameters as those discussed as well as similar ones. If the missing ink jets are evaluated to have minimal impact on the printing operations of the device, the operational mode is set to operate-with-missing-jets. If a recovery action is identified, but the time for the action is not immediate, the operational mode is set to jet substitution, which may include a speed alteration parameter as noted above. If a recovery action is identified and the time for the action has been reached, the operational mode is set to recovery mode.

The process detects the operational mode of the system and responds accordingly (blocks 428, 432, and 444). If the mode is operate-with-missing-jets (block 428), the system is ready for printing (block 412). If the mode is jet substitution (block 432), the recovery action and time may be stored in a recovery mode table or a historical record for an ink jet or printhead sector. The process determines whether the current printing speed is to be changed (block 436), and adjusts the speed, required (block 440). The device is then ready to print (block 412). If the mode is the recovery mode (block 444), the recovery action(s) are performed (block 448). Otherwise, exception processing is performed for the undefined operational mode (block 460). The recovery actions include the warm purge and/or freeze-thaw operations discussed above for recovery of ink jets as well as the other recovery actions previously discussed. Following the performance of the recovery action(s), a scan of the ink jets is performed to determine whether the recovery action(s) were successful and to update the history records appropriately. After determining that all ink jets capable of recovering have been recovered, another scan is performed (block 404) and evaluated (blocks 408-448) to determine whether any ink jets are to have their status set to chronic ink jet with the corresponding error code display discussed above.

In operation, the controller of an imaging system is configured with programmed instructions and corresponding interface circuitry to schedule ink jet recovery actions with reference to ink jet usage and/or location. In response to an image evaluator implemented with the controller or associated circuitry detecting a missing or weak ink jet, the controller updates historical records, identifies recovery action and times for performance, and identifies an operational mode for the ink image generating system. The recovery action identification, time of performance, and operational mode setting may be made with reference to a usage history, maintained with a counter or the like, reference to the location of the ink jet on the printhead, or other historical data regarding system operation or configuration. The controller operates the ink image generation system in the appropriate mode and may adjust the printing speed for some jet substitution mode operation. Once the time for the recovery mode operation is reached, the controller operates the printheads to implement one or more ink jet recovery actions. Once the controller detects an end to the recovery actions, the historical records are updated, another scan conducted, and the status of chronic jets detected. The ink jet(s) identified as being chronic result in the controller displaying a chronic ink jet code on the imaging system. The controller continues to operate the imaging system in an appropriate operational mode until a service procedure occurs that addresses the missing or weak ink jet.

While the processes discussed above relate to automatic detection of missing jets and the scheduling of recovery actions to address the ink jets so identified, an image capture device may be unable to capture the missing jet performance in a digital image of the image receiving member. Consequently, a missing jet may not be detected by the image evaluator. A user or a service technician, however, may detect the missing jet in images generated by the imaging system. Upon such manual detection, the user or technician may set the operational mode of the imaging system through a user interface and override the operational modes determined by the processes described above. This type of system operation may be selected to keep the system generating some types of images until a more comprehensive service visit occurs.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A system for operating an ink jet image generating system comprising:

an image capture device configured to generate a digital image of an ink image on an image receiving member of an ink jet image generating system;

an image evaluator configured to detect missing inkjets in a printhead of an ink jet image generating system from the digital image of the ink image on the image receiving member; and a controller configured to select one of an operate-with-missing-jets mode, a substitution mode, and a recovery mode as an operational mode for the ink jet image generating system in response to the image evaluator detecting at least one missing ink jet, to update a history record for each missing jet detected by the image evaluator, the history record including an ink jet usage parameter, a number of times detected as being missing count, a number of times recovered count, and a position of ink drops ejected by the ink jet detected to be missing, and to identify a detected missing ink jet as being a bad jet in response to the number of times detected as being missing count in the history record for the detected missing ink jet being equal to or greater than a predetermined threshold.

2. The system of claim 1, the controller being further configured to identify a detected missing ink jet as being a bad jet in response to the number of times recovered count in the history record for the detected missing ink jet being equal to or greater than a predetermined threshold.

3. The system of claim 1, the controller being further configured to identify a recovery action and one of the operational modes for the ink jet image generating system in response to the ink jet usage parameter being equal to or greater than a predetermined percentage of a number of ink image generations.

4. The system of claim 1, the controller being further configured to identify a recovery action and one of the operational modes for the ink jet image generating system in response to the position of ink drops ejected by the ink jet being within a predetermined printing zone on the image receiving member.

5. The system of claim 1, the controller being further configured to identify a recovery action and one of the operational modes for the ink jet image generating system in response to the number of missing jets detected by the image evaluator being equal to or greater than a predetermined number of missing jets.

6. The system of claim 1, wherein the history record includes an ink jet color and the controller is further configured to identify a recovery action and one of the operational modes for the ink jet image generating system in response to the ink jet image generating system being configured to generate color images.

7. The system of claim 1, the controller being further configured to alter a printing speed in response to selection of the substitution mode.

8. The system of claim 1, the controller being further configured to perform one of a cessation of use of a missing ink jet for a predetermined period of time, applying a voltage to the missing ink jet that is less a first firing signal threshold, applying a voltage to the ink jet that is significantly higher than a second firing signal threshold, and pulsing a voltage applied to the missing ink jet to attempt to eject ink rapidly over a predetermined period of time in the recovery mode.

9. A method for operating an ink jet image generating system comprising:

generating a digital image of an ink image on an image receiving member of an ink jet image generating system;

detecting missing inkjets in a printhead of an ink jet image generating system from the digital image of the ink image on the image receiving member;

selecting one of an operate-with-missing-jets mode, a substitution mode, and a recovery mode as an operational mode for the ink jet image generating system in response to the detection of at least one missing ink jet;

updating a history record for each detected missing jet, the history record including an ink jet usage parameter, a number of times detected as being missing count, a number of times recovered count, and a position of ink drops ejected by the ink jet detected to be missing; and identifying a detected missing ink jet as being a bad jet in response to the number of times detected as being missing count in the history record for the detected missing ink jet being equal to or greater than a predetermined threshold.

10. The method of claim 9 further comprising:

identifying a detected missing ink jet as being a bad jet in response to the number of times recovered count in the history record for the detected missing ink jet being equal to or greater than a predetermined threshold.

11. The method of claim 9 further comprising:

identifying a recovery action and one of the operational modes for the ink jet image generating system in response to the ink jet usage parameter being equal to or greater than a predetermined percentage of a number of ink image generations.

12. The method of claim 9 further comprising:

identifying a recovery action and one of the operational modes for the ink jet image generating system in response to the position of ink drops ejected by the ink jet being within a predetermined printing zone on the image receiving member.

13. The method of claim 9 further comprising:

identifying a recovery action and one of the operational modes for the ink jet image generating system in response to the number of missing jets detected by the image evaluator being equal to or greater than a predetermined number of missing jets.

14. The method of claim 9 further comprising:

identifying a recovery action and one of the operational modes for the ink jet image generating system in response to the ink jet image generating system being configured to generate color images.

15. The method of claim 9 further comprising:

altering a printing speed in response to selection of the substitution mode.

16. The method of claim 9 further comprising:

performing one of a cessation of use of a missing ink jet for a predetermined period of time, applying a voltage to the missing ink jet that is less a first firing signal threshold, applying a voltage to the ink jet that is significantly higher than a second firing signal threshold, and pulsing a voltage applied to the missing ink jet to attempt to eject ink rapidly over a predetermined period of time in response to the selection of the recovery mode.

* * * * *